US005869794A

United States Patent [19]

Spiess

[11] Patent Number: 5,869,794

[45] Date of Patent: Feb. 9, 1999

[54] METHOD AND DEVICE FOR INCREASED SAFETY IN ELEVATORS

[75] Inventor: Peter Spiess, Meggen, Switzerland

[73] Assignee: Inventio AG, Hergiswil, Switzerland

[21] Appl. No.: 744,426

[22] Filed: Nov. 7, 1996

[30] Foreign Application Priority Data

Nov. 8, 1995 [CH] Switzerland ..... 03158

[51] Int. Cl.[6] ..... B66B 5/06; B66B 1/34

[52] U.S. Cl. ..... 187/287; 187/393; 187/283

[58] Field of Search ..... 187/390, 391, 187/393, 394, 286, 287, 288, 293

[56] References Cited

U.S. PATENT DOCUMENTS

| | | | |
|---|---|---|---|
| 2,581,297 | 1/1952 | Rissier | 187/83 |
| 2,657,765 | 11/1953 | Savage | 187/29 |
| 4,887,695 | 12/1989 | Kindler et al. | 187/116 |
| 5,070,967 | 12/1991 | Katzy et al. | 187/116 |
| 5,366,045 | 11/1994 | Liston | 187/276 |
| 5,597,987 | 1/1997 | Gilliland et al. | 187/285 |

FOREIGN PATENT DOCUMENTS

| | | | |
|---|---|---|---|
| 0110095 | 6/1984 | European Pat. Off. | B66B 1/16 |
| 0498597 | 8/1992 | European Pat. Off. | B66B 5/22 |
| 2128662 | 12/1971 | Germany | B66B 5/20 |
| 3818083 | 12/1988 | Germany | B66B 3/02 |
| 3934492 | 4/1990 | Germany | B66B 1/32 |

*Primary Examiner*—Robert Nappi
*Attorney, Agent, or Firm*—Greenblum & Bernstein, P.L.C.

[57] ABSTRACT

Method and device for stopping of an elevator cage due to a deviation of the elevator position, acceleration, or speed from a travel curve in excess of a certain predetermined safety margin. Travel parameters, computed by the elevator control, may be passed on to a drive control of a cage drive for moving and positioning of the elevator cage, and may also be passed on to a drive control of a reference drive for moving and positioning a trigger part. Accordingly, each of the elevator cage and the trigger part may be driven by individual discrete drivers, but, due to each driver receiving the same travel parameters, the elevator cage and the trigger part move in synchronization. The trigger part may be coupled to the elevator cage to be movable when the elevator cage deviates from the computed travel curve. When the deviation from the travel curve exceeds a predetermined safety margin, the trigger part may actuate a safety switch to stop the cage or reference drivers or to arrest movement of the elevator cage.

19 Claims, 3 Drawing Sheets

METHOD AND DEVICE FOR INCREASED SAFETY IN ELEVATORS

CROSS REFERENCE OF RELATED APPLICATIONS

The present invention claims the priority under 35 U.S.C. § 119 of Swiss Patent Application No. 03 158/95 filed Nov. 8, 1995, the disclosure of which is expressly incorporated by reference herein in its entirety.

BACKGROUND OF THE INVENTION

1. Field of the Invention

The present invention is directed to a method and a device for increasing elevator safety by triggering appropriate emergency stops or other safety devices in the event the elevator cage deviates from the travel curve by more than predetermined safety margins.

2. Discussion of Background Information

Modern elevators have an elevator control which computes travel parameters for a travel of an elevator cage for an individual elevator cage and/or for groups of cages according to optimized algorithms and applicable safety regulations. The elevator control passes these travel parameters to a control for a cage drive, as described in, for example, patent specification EP 0 100 095, the disclosure of which is incorporated by reference in its entirety. Usually, and as evident from patent specifications DE 3 818 083 and U.S. Pat. No. 4,887,695, the disclosures of which are incorporated by reference in their entireties, additional means for monitoring the travel curve of the elevator cage are used for control of the cage drive. The travel curve represents a certain position of the cage at a certain time, and is corrected by control of the cage drive. In that case, only such deviations from the travel curve are permissible as lie within a certain, mostly prescribed, safety margin. When the safety margin is exceeded, safety is endangered.

Although these means for monitoring the travel curve for the control of the cage drive can ascertain deviations of the elevator cage from the computed travel curve, they are not, due to their direct connection with the cage control, suitable and/or permitted as a safety device for monitoring current failure, for example, for triggering a safety switch. Consequently, additional means, which are independent of the control of the cage drive, are necessary to monitor failure of the cage drive, cable fracture, current failure, excessive speed of the elevator cage, or any other impermissible disturbance, and to trigger an emergency stop or another safety device of the elevator cage.

Speed limiters are known in particular which, as described in, for example, patent specification EP 0 498 597, the disclosure of which is incorporated by reference herein in its entirety, at excessive speeds of the elevator cage in one of the directions of travel, mechanically trigger a braking system, denoted as an arresting device. Tachometers, which have a voltage dependent on speed for the triggering of a braking system (see, e.g., U.S. Pat. No. 5,366,045 or DE 2 128 662) are known. It is also known to utilize acceleration sensors for the recognition of disturbances (see, e.g., DE 3 934 492). The disclosures of each of the above-noted documents are incorporated by reference herein in their entireties. A significant disadvantage of these safety systems is that the emergency stop, which is triggered in the case of a corresponding disturbance, always takes place through an arresting device of the elevator cage. This often leads to a substantial jerking or jarring of the elevator cage, to difficultly releasing wedging of the brakes with the guide elements of the elevator cage and/or to damage of these parts. Moreover, in certain cases these safety systems have a relatively large delay. Thus, for example, a cable fracture or a current failure leads to a triggering of the arresting device only when excessive acceleration or speed triggers the corresponding system. None of the known safety systems is capable of recognizing deviations from the position, the speed and the acceleration of the elevator cage. Optical, electronic, electromagnetic or other sensors, for example, a distance-measuring device operating with laser beams, are known and can ascertain position, speed, and acceleration. However, these devices cannot ensure the required safety. Further, these systems are very susceptible to faults, for example, due to electromagnetic fields, dust, or vibrations, and therefore, require a very high effort for maintenance, calibration and upkeep. These devices have a direct as possible mechanical connection between the recognition of an impermissible deviation and the triggering of a safety device, which is usually required.

SUMMARY OF THE INVENTION

An object of the present invention lies in supplying a method and a device for the early recognition of disturbances and deviations from an optimum travel curve and of speed and acceleration of the elevator cage beyond predefined safety margins. The method and device may also trigger emergency stops or other safety measures which are substantially independent of the control of the cage drive, and which overcome the aforementioned disadvantages.

According to the present invention, this problem may be solved by a method or a device, in which travel parameters associated with the computed travel curve from an elevator control and are passed to a cage drive control moving and positioning the elevator cage, and are passed to a reference drive control so that a trigger part, moved and positioned by the reference drive, has the same travel curve computed by the elevator control. The trigger part may be connected with the elevator cage and may be movable to trigger a safety switch for stopping the elevator cage in case the elevator cage deviates from the travel curve beyond a certain, predetermined, safety margin.

The reference drive control may be a control device equipped with microprocessors for regulable drives and motors. The travel parameters computed by the elevator control for the travel of the elevator cage may be taken as data by the reference control and converted into corresponding control signals for the supply of the reference drive. The reference drive, which may be, e.g., an electric motor, causes movement of a trigger part extending parallel to the elevator cage. This movement can, for example, arise by the reference drive being mounted in a fixed location at an upper end of a shaft, in which the elevator cage moves vertically, and driving an endless cable, thereby, moving the trigger part fastened thereto according to the travel curve, in a same vertical line as the elevator cage. Alternatively, the reference drive may drive a travelling mechanism to move vertically in the shaft along a guide rail of the elevator cage and to guide the trigger part, at a cable or rigid means, for example a lightweight metal carrier, according to the travel curve. Further solutions for the parallel guidance of the trigger part with respect to the movement of the elevator cage are generally understood by those ordinarily skilled in the art. Since the reference drive drives only the trigger part and its retaining means, this can be dimensioned to be correspondingly small so that, for example, a bridging-over of current failures by means of batteries or accumulators is possible without great effort. The substantially smaller and more uniform loading of the reference drive in comparison with the cage drive, generally increases its reliability. Further, additional sensors can be used for the regulation of the reference drive control. The trigger part may be a component which adjoins the elevator cage to the extent that a controllable movement of the trigger part relative to the elevator cage is possible. A guide, which extends parallel to the movement of the trigger part and to the elevator cage, for example, a U-shaped section, can receive the trigger part and make possible a guided relative displacement in the case of deviating travel curves of the trigger part and the elevator cage. A controlled movement may also be possible by an axle displaced from the means, by which the reference drive retains and guides the trigger part and which connects the trigger part with elevator cage to be rotatable. Thus, in the case of a deviation of the travel curves of the elevator cage and the trigger part, the trigger part may be displaced relative to the elevator cage, turned about the axle or otherwise moved proportionally to the deviation, according to the guide.

In the ideal case, no deviations occur so that the trigger part moves synchronously with the elevator cage, and no relative movements between the trigger part and the elevator cage arise. In practice, however, certain deviations of the elevator cage from the computed ideal travel curve may occur, which can emanate from, for example, the changing loading of the elevator cage, temperature fluctuations in the shaft, different cable elasticities in dependence on the number of stories, and other known influences. The deviations, for technical and/or legal reasons, may not be greater than certain maximum magnitudes, denoted as safety margins, in order to prevent a danger for the elevator cage or its load. Examples of dangers or faults are travelling beyond stories, or shaft ends, excessive cable elongation caused by overload, or overloading of the drive up to the point of fracture of the cable.

According to the present invention, a switch, which may be an optical, electrical, electromechanical, or purely mechanical switch, may be mounted at the elevator cage in such a manner that, when the tolerable deviation is exceeded, the switch may be appropriately actuated by the movement of the trigger part relative to the elevator cage. The actuation of the switch can furthermore trigger an alarm, an emergency stop of the drives, or any other existing safety equipment, for example, an arresting device, or other additional safety devices. It is also a feature of the present invention that a further switch may be mounted at the cage so that a safety margin is given during the upward travel as well as downward travel of the elevator.

A preferred embodiment of the invention may include mounting several safety switches for indicating exceeding different safety margins. Thus, according to the deviations from the travel curve, an alarm, for example, can be triggered before an emergency stop of the drives is caused by a second switch, or an arresting device is mechanically actuated directly by another switch. It is also advantageous if the safety margins are variable by displaceable switches or switches which can be switched on and off. Thus, a smaller safety margin can be set, for example, at either the beginning or end of the travel curve, where the position of the elevator cage must agree as accurately as possible with the corresponding story.

Accordingly, the present invention may also be directed to a method for monitoring a predetermined travel path in an elevator system and for actuating at least one of a plurality of safety devices in response to deviation from the predetermined travel path beyond a predetermined threshold. The method may include computing the predetermined travel path, forming travel parameters associated with the predetermined travel path, forwarding the travel parameters to a reference drive for driving a trigger part along the predetermined travel path and to a cage drive for driving the elevator cage along the predetermined travel path, detecting when one of the trigger part and the elevator cage deviate from the predetermined travel path, and triggering the at least one safety device when the deviation from the predetermined travel path exceeds the predetermined threshold.

In accordance with another feature of the present invention, the predetermined threshold may include a plurality of safety margins and the at least one safety device comprises a plurality of safety devices. The method may further include positioning the trigger part for movement relative to a plurality of switches, where each of the plurality of switches may be associated with a unique one of the plurality of safety margins and with one of the plurality of safety devices.

In accordance with yet another feature of the present invention, the method may further include mounting the reference drive to a top of an elevator shaft in which the elevator cage is operating.

In accordance with alternative feature of the present invention, the method may include the trigger part coupled to a cable driven by the reference drive.

In accordance with a further feature of the present invention, the reference drive may be substantially synchronously moving with the elevator cage until at least one of the reference drive and trigger part deviate from the predetermined travel path.

According to another aspect of the present invention, the present invention may be directed to a safety device for an elevator system including an elevator cage for traversing an elevator shaft. The device may include a trigger part for traversing the elevator shaft, a device for substantially synchronizing movement of the trigger part and the elevator cage, a device for detecting relative movement between the elevator cage and the trigger part, and a device for triggering at least one safety device when the detected relative movement exceeds a predetermined threshold.

In accordance with another feature of the present invention, the substantially synchronizing device may include a control device for computing a travel curve and for converting the travel curve into travel parameters, an elevator cage drive for receiving the travel parameters and for driving the elevator cage in accordance with the travel curve, and a reference drive for receiving the travel parameters and for driving a trigger part in accordance with the travel curve.

In accordance with yet another feature of the present invention, the reference drive may be mounted to a top of the elevator shaft.

In accordance with an alternative feature of the present invention, the reference drive may be substantially synchronously moving with the elevator cage until at least one of the reference drive and trigger part deviate from the travel curve.

In accordance with yet another feature of the present invention, the device for detecting relative movement between the elevator cage and the trigger part may include at least one switch actuatable by the trigger part.

In accordance with still another feature of the present invention, the at least one switch may include a plurality of safety switches, where each of the plurality of safety switches associated with unique amount of relative movement between the elevator cage and the trigger part.

In accordance with a further feature of the present invention, the at least one safety device may include an emergency stop switch for each of the elevator cage drive and the reference drive, and an arresting device for the elevator cage including a mechanical trigger.

The present invention can also be used for existing safety systems. For example, play may be introduced between the elevator cage and a limiter cable, which drives a speed limiter, so that the limiter cable may be driven by the reference drive. Within the play clearance, appropriate switches can be positioned which, is addition to the arresting device, can trigger other safety devices, such as for example, an emergency stop of the drives, before the arresting device is triggered.

As discussed above, practically all deviating from the travel curve is a danger to safety. A significant advantage of the present invention is that deviations from the travel curve for example, over-travels of stories or shaft ends, too high and too low speeds or accelerations, impermissible cable elongations, and cable fractures, may be recognized and, on the exceeding of the safety margins, trigger appropriate safety switches. The possibility of utilizing several different safety margins for actuating an alarm, an emergency stop of the drives, or any other safety device that can be triggered before the arresting device is actuated is of particular advantage. In most cases, the arresting device may also be triggered earlier in accordance with deviations from the travel curve, i.e., before the response of the speed limiter and before reaching a maximum speed. The wedging and damage between the brakes and the guide rails of the elevator cage typically caused by the arresting device become substantially smaller due to the smaller arresting forces. In particular, the arresting forces increase with the square of the speed. The braking forces and the jerking or jarring of the load of the elevator cage are also correspondingly smaller. The method and its device for the performance are substantially more reliable by comparison with purely electronic and/or sensor systems due to the constrained, i.e., mechanical, coupling of recognition of the disturbance and triggering of a safety device.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENT

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
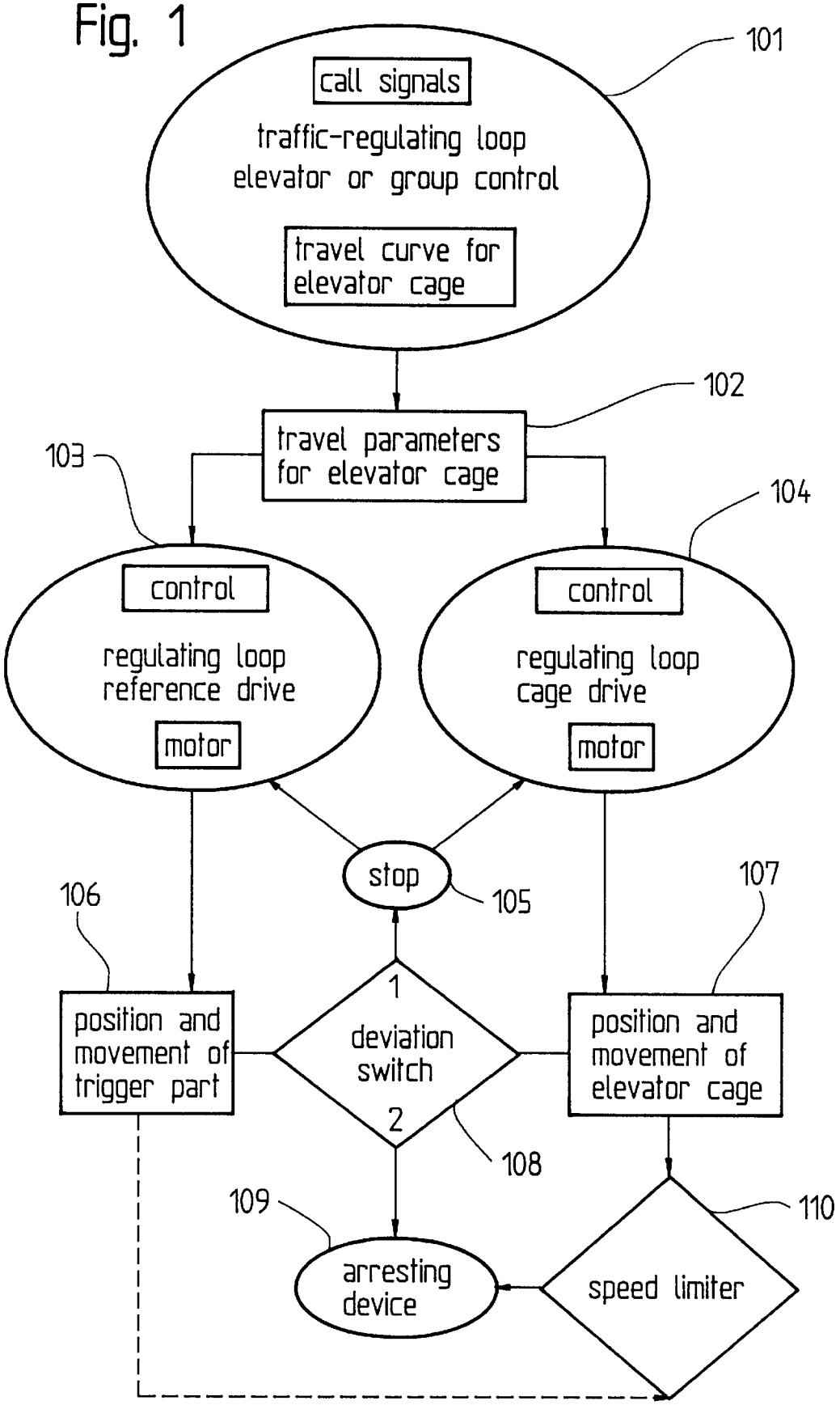
FIG. 1 shows an exemplary flow diagram for performing the method of the present invention.

The exemplary flow diagram illustrated in FIG. 1 shows a method for performing a traffic-regulating loop which is formed substantially by an elevator control or, in the case of several elevator cages, by a group control. The call signals and other inputs originating from an operating panel on each story or in the elevator cage are detected by the elevator control in step 101 and converted, by present control programs, into corresponding travel parameters in step 102. The elevator or group control may also compute and store a travel curve (or travel path) to be utilized in controlling the elevators. In step 104, the travel parameters are passed on as signals or data to a control of a cage drive. The cage drive control may move and monitor the position of the elevator cage from an actual story to a desired story according to the computed travel curve. The elevator cage control, in step 107, may form a regulating loop which detects the position, acceleration, and speed of the elevator cage in accordance with the travel curve. The elevator cage may, in step 110, drive a speed limiter through a fixed connection. The speed limiter may, upon exceeding an adjustable, maximum permissible speed, trigger an arresting device, in step 109. For increased safety, i.e., to improve monitoring of the position, speed, and acceleration of the elevator cage, and to recognize deviation from the travel curve, the travel parameters are also passed on to a control of a reference drive in step 103. The reference drive substantially forms a regulating loop that moves and monitors the position of a trigger part synchronously running with the elevator cage, in step 106, as the elevator cage is moved along the computed travel curve. In that case, a connection of the trigger part with the elevator cage may be made such that a controlled movement of the two parts relative to each other is possible. In trouble-free operation, the trigger part and the elevator cage move synchronously in the range of ideal travel curve, i.e., within tolerable deviations (safety margins). In step 108, the safety switches may trigger a safety device when a deviation, greater than a predetermined safety margin or threshold, of the cage from the travel curve occurs. Safety switches may be mounted at the elevator cage and along a path of the checked relative movement of the trigger part and the elevator cage. If several safety switches are used for monitoring various deviations, different safety devices can be actuated optically, electrically, electromechanically and/or purely mechanically. In such a case, a mechanical triggering of the arresting device may be realized as an electrical emergency stop of the drives and may be actuated in step 105. Further embodiments of the present invention are possible, in which a speed limiter may be coupled to the reference drive monitoring the position and movement of the trigger part, as indicated by the dashed line. For example, the limiter cable and thereby the speed limiter can be driven by the reference drive. Play, according to the tolerable deviations of the elevator cage from the travel curve, may be incorporated between the trigger of the arresting device and the limiter cable. Further, additional safety devices can be mounted within the play clearance so that an emergency stop of the drives may be caused within the play clearance by a trigger part before the arresting device is triggered.

Figure 2:
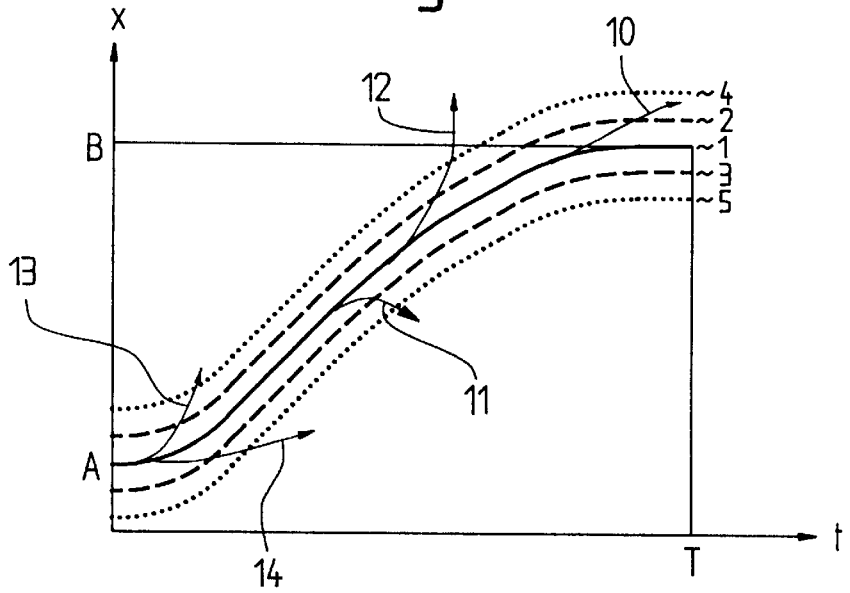
FIG. 2 schematically shows a travel curve with tolerances and deviations or disturbances.

FIG. 2 shows an exemplary diagram of the travel curve and several monitored safety margins associated therewith. The diagram is shown with time (t) as ordinate and the travel path (x) as abscissa. The travel curve 1, illustrated schematically as a continuous S-curve, represents travel from a starting story A to a destination story B within a certain time T. Technically required and/or legally prescribed safety margins are illustrated by dashed and dotted lines following the travel curve. According to predetermined safety margins, safety margins 2 and 3 can be smaller or 4 and 5 can be greater and lie in the direction of travel or opposite to the direction of travel. The travel curve may be changed and corrected appropriately in the case of desired intermediate stops between the starting story A and the first destination story B because the travel parameters are adapted and the mostly constant safety margins go along the new travel curve.

The safety margins represent not only deviations in the position of the elevator cage from the travel curve, but can also, according to known mathematical conversions, indicate a maximum speed or acceleration which leads to a corresponding deviation. FIG. 2 furthermore shows possible disturbances which can lead to safety-endangering deviations of the elevator cage from its travel curve, e.g., overtravelling 10 of the destination story or the shaft ends, excessive speed 12, cable fracture 11 or the failure of a suspension, excessive acceleration 13, under-acceleration 14, or excessive cable elongation on overload. Each of the above-noted deviations must be recognizable to the system so that safety devices, e.g., an alarm, an emergency stop, or an arresting device, can be triggered when the safety margins are exceeded.

Figure 3:
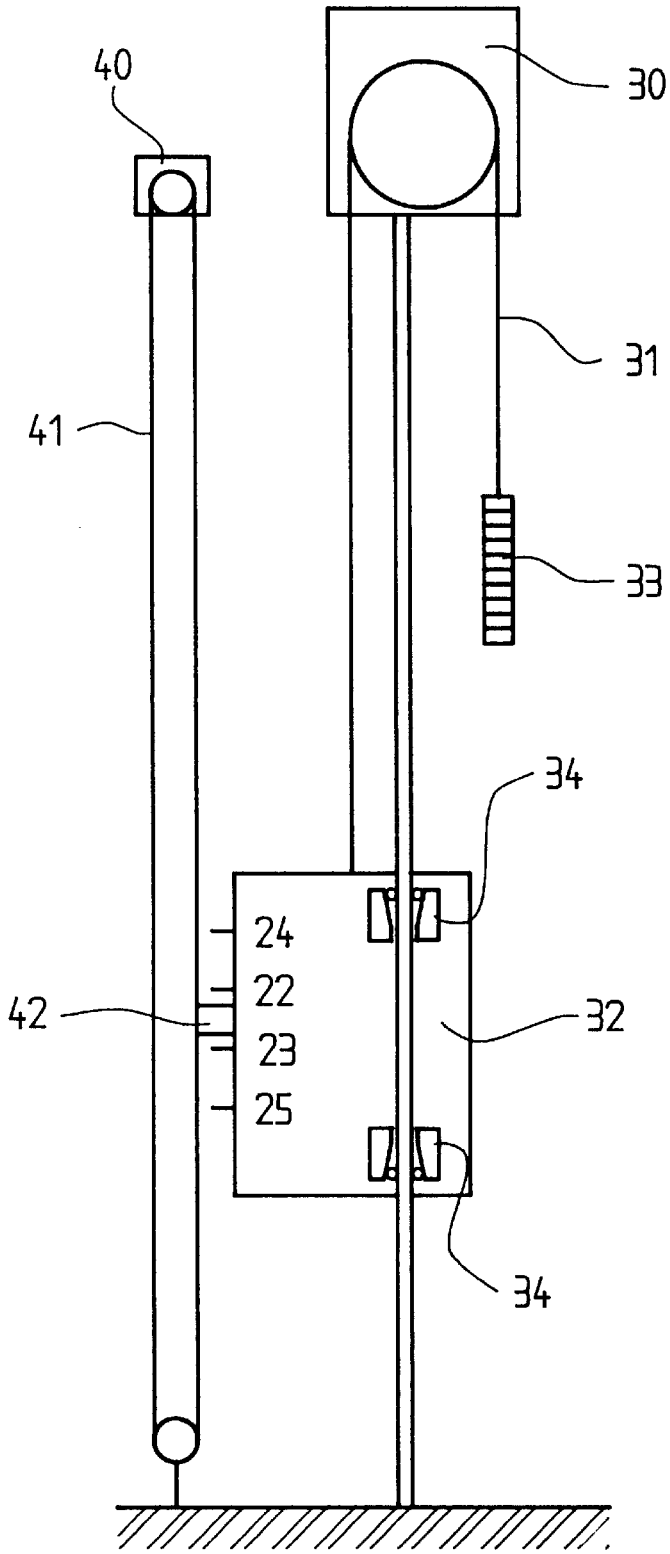
FIG. 3 schematically shows an elevator with a device according to the present invention with a reference drive of fixed location.

FIG. 3 schematically shows a device in accordance with the present invention. Assuming that the elevator cage depicted moves along travel curve 1, as shown in FIG. 2, the present invention, as embodied in FIG. 3, can recognize an exceeding of safety margins 2, 3, 4, and 5. The device may include safety switches 22, 23, 24 and 25, which correspond to safety margins 3, 4, 2, and 5, respectively, and trigger safety devices. The safety switches may be coupled to the elevator cage 32, which is moved along a vertical line, e.g., a guide rail 50, by a cable 31 through an elevator drive 30 and a counterweight 33. A reference drive 40, of fixed location, moves a trigger part 42 which is usually disposed between the safety switches 22 and 23. The trigger part synchronously moves with safety switches and along the travel curve of the elevator cage via an endless cable 41. The synchronous movement of the trigger part and the elevator cage is accomplished by the travel parameters being forwarded to the respective cage and reference drive controls. Thus, while synchronously moving together, the cage and trigger part are separately driven. Thus, any variation (or deviation) of the elevator cage from the travel curve causes the trigger part to move out of synchronization with the elevator cage and its safety switches 22, 23, 24, and 25 to, therefore, actuate an appropriate safety device, etc.

Figure 4:
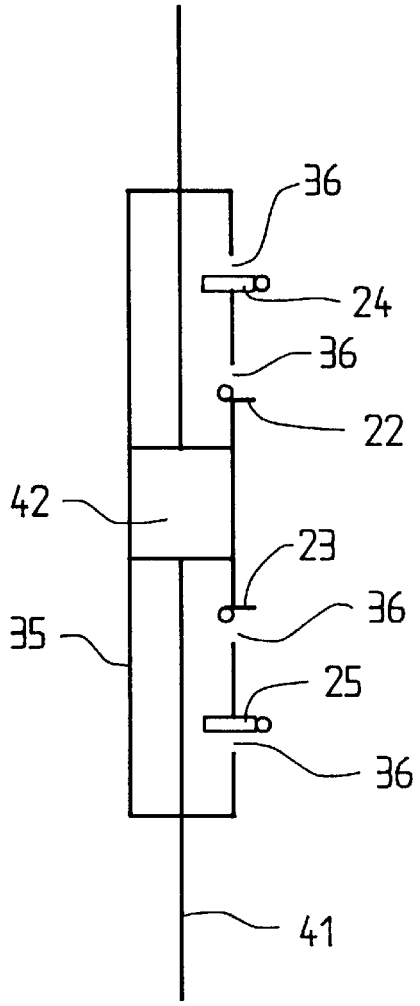
FIG. 4 schematically shows a trigger part in a guide with safety switches.

The transition or the connection between trigger part 42 and elevator cage 32 is indicated schematically in FIG. 4. The trigger part 42 slides in a U-shaped section guide 35 fastened to elevator cage 32. Guide 35 may include a plurality recesses 36 on one side. Safety switches 22, 23, 24, and 25 project through these recesses 36 into the interior of guide 35. These safety switches can be, e.g., electrical switches 22 and 23 or may be, e.g., mechanical trigger devices 24 and 25 for an arresting device 34. The actuation of a safety switch 22, 23, 24 and 25 takes place when the trigger part 42 is displaced relative to the elevator cage 32. The trigger part 42 may move upward or downward, with respect to elevator cage 32, within guide 25 and trigger at least one corresponding safety switch on exceeding a respective recess 36. The positioning of the safety switches 22, 23, 24, and 25 takes place according to the desired safety margins 2, 3, 4 and 5, which are illustrated in FIG. 1, for the travel curves of an elevator.

Figure 5:
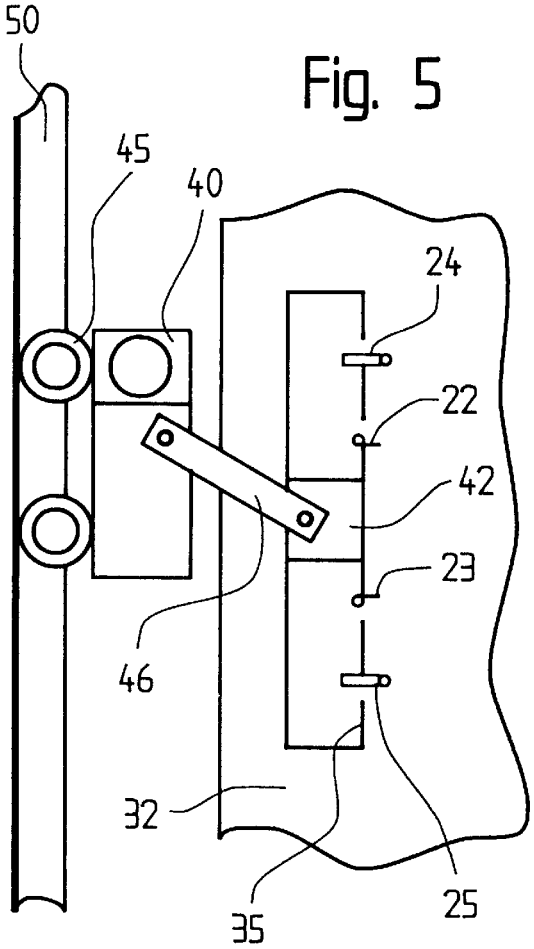
FIG. 5 schematically shows a device according to the present invention with an automatic reference drive, as well as trigger part.

FIG. 5 illustrates a reference drive 40 which moves upwardly or downwardly, according to the computed travel curve, along a guide rail 50 of elevator cage 32 by means of a wheel frame 45. The trigger part 42 may be retained by, or coupled to reference drive 40, through a member 46 of stable shape, for example, a lightweight metal carrier, which may be fastened to the moving reference drive 40 so that a movement of the trigger part 42 arises which is synchronous with the reference drive 40. The triggering of a safety switch 22, 23, 24 and 25 takes place analogously to the principle described in FIG. 4 when deviation from the travel curve by the elevator cage causes relative movement between the triggering part 42 and the elevator cage sufficient to surpass or exceed at least one of the safety switches 22, 23, 24, or 25.

Figure 6:
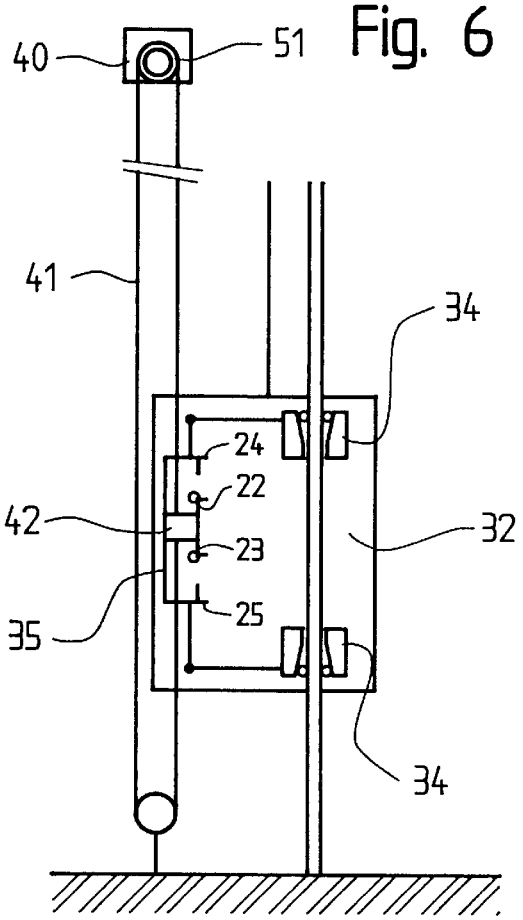
FIG. 6 schematically shows a device according to the present invention and coupled with a speed limiter.

In FIG. 6, a speed limiter 51 as well as an endless or limiter cable 41 is driven by the reference drive 40. A trigger part 42, which slides in guide 35, is fastened to the endless cable 41. The trigger part 42 can move within an upper and a lower portion of guide 35 to actuate mechanically triggering safety switches for arresting device 34. Further safety switches 22 and 23, may be utilized to detect exceeding the corresponding safety margins or deviations from the travel curve by the elevator cage. Safety switch 22 or 23, for example, may trigger an alarm or an emergency stop of the drives 30 and 40 and can be mounted between safety switches 24 and 25. The safety switches 24 and 25 of arresting devices 34 have a certain triggering force which, in the case of failure of reference drive 40, is great enough to drive the limiter cable 41 by way of the trigger part 42 and thus the speed limiter 51, but smaller than arises on the response of the speed limiter 51 due to jerky or jarring stopping.

Further embodiments according to the method of the invention are feasible for new elevators or as addition for existing elevators, in particular for an increased safety for passenger elevators.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. For example, the trigger part may indicate relative deviation between the paths travelled by the trigger part and the elevator cage. Further, the trigger part may indicate when the trigger part has deviated from the travel curve beyond the predetermined safety margins. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. Method for ascertaining a deviation of an elevator cage from a travel curve which has been computed by an elevator control, the method comprising:

passing of travel parameters to a drive control of a cage drive for moving and positioning the elevator cage;

stopping of the elevator cage when at least one predetermined safety margin is exceeded;

passing the travel parameters to a drive control of a reference drive so that a trigger part, which is moved and positioned by the reference drive, has the same travel curve computed by the elevator control, wherein the trigger part is coupled to the elevator cage to be movable in such a manner that a safety switch for stopping of the elevator cage is triggered by the trigger part in case the deviation of the elevator cage from the travel curve is greater than the at least one predetermined safety margin.

2. Method according to claim 1, the at least one predetermined safety margin including at least two safety margins, triggering a first safety switch upon a first deviation;

stopping of the cage drive and of the reference drive in response to the triggering of the first safety switch;

triggering a second safety switch upon a second deviation greater than the first deviation; and arresting movement of the elevator cage in response to the triggering of the second safety switch.

3. Method according to claim 2, wherein at least one safety margin is variable in that the corresponding safety switch is displaceable.

4. Method according to claim 2, wherein at least one safety margin is variable in that safety switches are switched on and off.

5. Device for monitoring deviation of an elevator cage from a predetermined travel curve, comprising:

a reference drive including an electrical motor controlled by travel parameters associated with the predetermined travel curve;

a trigger part, said reference drive driving said trigger part along the predetermined travel curve, an elevator cage drive controlled by the travel parameters associated with the travel curve, the elevator cage drive driving the elevator cage along the predetermined travel curve;

said trigger part coupled with the elevator cage for detecting a deviation between the paths travelled by said trigger part and the elevator cage; and at least one safety switch actuatable by said trigger part upon the detected deviation exceeding a predetermined safety margin.

6. Device according to claim 5, said predetermined safety margin comprising a plurality of safety margins, each of said plurality of safety margins indicative of an amount of deviation from the predetermined travel curve;

said at least one safety switch comprising a plurality of safety switches, each of said plurality of safety switches associated with a respective safety margin and actuatable upon exceeding said respective safety margin, said plurality of safety switches comprising an emergency stop switch for each of said elevator cage drive and said reference drive, and an arresting device for the elevator cage including a mechanical trigger.

7. Device according to claim 6, said plurality of safety switches comprising means for varying the associated safety margins.

8. Device according to claim 5, further comprising a speed limiter coupled to said reference drive.

9. A method for monitoring a predetermined travel path in an elevator system and for actuating at least one of a plurality of safety devices in response to deviation from the predetermined travel path beyond a predetermined threshold, said method comprising:

computing the predetermined travel path;

forming travel parameters associated with the predetermined travel path;

forwarding the travel parameters to a reference drive for driving a trigger part along the predetermined travel path and to a cage drive for driving the elevator cage along the predetermined travel path;

detecting when one of the trigger part and the elevator cage deviate from the predetermined travel path; and triggering the at least one safety device when the deviation from the predetermined travel path exceeds the predetermined threshold.

10. The method according to claim 9, wherein the predetermined threshold comprises a plurality of safety margins and the at least one safety device comprises a plurality of safety devices, and the method further comprises positioning said trigger part for movement relative to a plurality of switches, each of said plurality of switches associated with a unique one of the plurality of safety margins and with one of the plurality of safety devices.

11. The method according to claim 9, further comprising:

mounting the reference drive to a top of an elevator shaft in which the elevator cage is operating.

12. The method according to claim 9, further comprising:

the trigger part coupled to a cable driven by the reference drive.

13. The method according to claim 9, further comprising:

the reference drive substantially synchronously moving with the elevator cage until at least one of the reference drive and trigger part deviate from the predetermined travel path.

14. A safety device for an elevator system, the elevator system including an elevator cage for traversing an elevator shaft, said device comprising:

a trigger part for traversing the elevator shaft;

a device for substantially synchronizing movement of said trigger part and said elevator cage, said substantially synchronizing device comprising a control device for computing a travel curve, said control device further for converting said travel curve into travel parameters, an elevator cage drive for receiving said travel parameters and for driving said elevator cage in accordance with said travel curve, and a reference drive for receiving said travel parameters and for driving said trigger part in accordance with said travel curve;

a device for detecting relative movement between the elevator cage and the trigger part; and a device for triggering at least one safety device when said detected relative movement exceeds a predetermined threshold.

15. The safety device according to claim 14, said reference drive mounted to a top of the elevator shaft.

16. The safety device according to claim 14, said reference drive substantially synchronously moving with the elevator cage until at least one of the reference drive and trigger part deviate from said travel curve.

17. The safety device according to claim 14, said device for detecting relative movement between the elevator cage and the trigger part comprising at least one switch actuatable by said trigger part.

18. The safety device according to claim 17, said at least one switch comprising a plurality of safety switches, each of said plurality of safety switches associated with unique amount of relative movement between the elevator cage and the trigger part.

19. The safety device according to claim 14, said at least one safety device comprising an emergency stop switch for each of said elevator cage drive and said reference drive, and an arresting device for the elevator cage including a mechanical trigger.

* * * * *